United States Patent [19]

Graham

[11] Patent Number: 4,712,587

[45] Date of Patent: Dec. 15, 1987

[54] CLEANING AND YARN CONDITIONING SYSTEM FOR WEAVING MACHINES

[76] Inventor: Walker O. Graham, 105 Sycamore Dr., Mauldin, S.C. 29662

[21] Appl. No.: 892,906

[22] Filed: Aug. 4, 1986

[51] Int. Cl.[4] ..... D03J 1/04

[52] U.S. Cl. ..... 139/1 C

[58] Field of Search ..... 139/1 B, 1 C; 112/225

[56] References Cited

U.S. PATENT DOCUMENTS 3,678,965 7/1972 Yamada ..... 139/1 C 4,157,722 6/1979 Tojo et al. ..... 139/1 C

*Primary Examiner*—Henry S. Jaudon

*Attorney, Agent, or Firm*—Dority & Manning

[57] ABSTRACT

In a weaving machine having a warp supply, a harness motion, a reed and filling insertion mechanism, vacuum chambers are provided adjacent to the weft insertion station for drawing air from the ambient atmosphere of the weave room across the weft yarn to concentrate the ambient air from the atmosphere onto such yarn and to condition the same, and also to move the air drawn from the ambient atmosphere across the adjacent surfaces of the weaving machine for removing fly, lint, dust, oil or the like from such surfaces, and for preventing such material from becoming incorporated into the fabric.

20 Claims, 9 Drawing Figures

Fig. 1
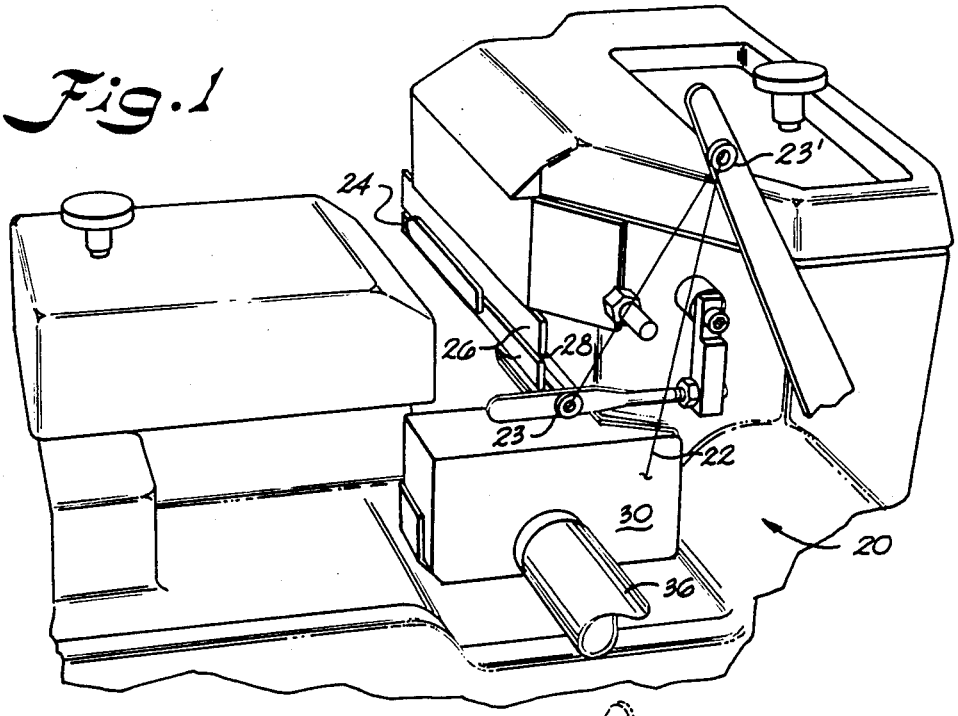
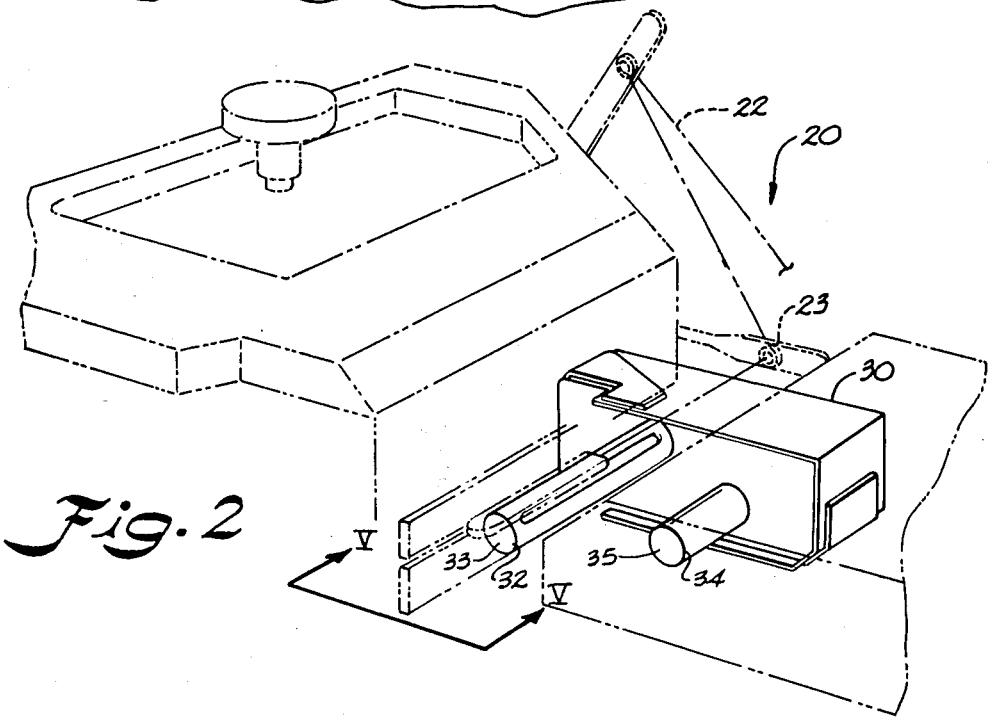
Fig. 2

CLEANING AND YARN CONDITIONING SYSTEM FOR WEAVING MACHINES

BACKGROUND OF THE INVENTION

This invention relates to improvements in a system for cleaning weaving machines, and at the same time, conditioning the weft yarns to improve both the quality of the fabric and the production of the weaving machines. The invention relates to equipment which is strategically located in an area of the weaving machine where a significant part of lint, fly, dust, oil, etc. are generated from the operation of the weaving machine.

Lint, fly and dust (hereinafter referred to as lint) are minute textile fibers, size and other particles which have become separated from the warp yarn or from the weft yarn at a number of different locations, especially where the warp yarns pass through the eyes of the drop wires, the eyes of the heddles, and between the blades of the reed. Lint is also generated from handling of the weft yarn. Such lint tends to collect on the surfaces of the weaving machine and is often incorporated into the fabric inadvertently when a large chunk of such lint falls off the surface of the weaving machine into the warp shed, or is entwined about individual warp or weft yarns and passes into the fabric past the beat-up point, resulting in defective fabric.

Lint is also objectionable because thick layers of the lint forming on the weaving machine surfaces may clog the weaving machine by falling into the weaving machine mechanisms and also collect oil used to lubricate the weaving machine. Furthermore, such large accumulations of this highly flammable material constitutes a fire hazard.

The general cleaning approach in most mills today is to permit the lint to accumulate on the surfaces of the weaving machine and periodically to manually blow such lint off of the weaving machine surfaces onto the floor where it is manually swept up by brooms. This removes a large amount of the lint; however, much of the lint is suspended in the air and lands back on the weaving machines, accumulates on the walls or ceilings, or into the fabric. With the high speed weaving machines used in today's textile plants, much production is lost due to the cleaning of the machines, therefore, it has become necessary to provide means for cleaning the weaving machines continuously to remove the bulk of the lint from the surfaces of the weaving machine while such machines are in operation.

Many attempts have been made to provide for a cleaning mechanism on weaving machines. One such attempt is shown in U.S. Pat. No. 3,627,201. This patent teaches a system which requires that each weaving machine be provided with a downwardly opening hood which fits snugly around the weaving machine and which has an annular rim around the downwardly directed opening thereof. The hood is supported by a mechanism which moves the hood upwardly and away from the operative position. The atmosphere within the hood is said to be maintained at a temperature of 15° to 50° C. by a source of air at that temperature which is supplied through the floor under the weaving machine. An exhaust conduit is also provided for leading the air injected into the hood outwardly after it has circulated around the weaving machine.

There are many problems connected with the device in U.S. Pat. No. 3,627,201. The main problem is that the mechanism is very cumbersome and it is very difficult for the weavers to have access to the weaving machines when broken warp yarns or the like must be repaired. Furthermore, the system disclosed in this patent does little or no cleaning of the surfaces of the weaving machine.

Another attempt was made in U.S. Pat. No. 3,378,998. In this patent, an attempt is made to provide an enclosure for the yarn manipulating mechanism of a weaving machine. A hood is provided for enclosing the upper portion of the weaving machine. This hood has an opening for receiving air. An air input means is connected to the opening in the hood. A central chamber is attached to the hood which encloses the working instrumentalities of the weaving machine at points where the lint is normally discharged and collects. A base enclosure is connected to the central chamber for receiving accumulated lint from the central chamber. A suction and collecting unit is provided for the base enclosure for creating a negative pressure within the hood. The flow of air through the enclosure is said to pass through the machinery and to maintain it substantially free from lint and fly.

The enclosure of U.S. Pat. No. 3,378,998 makes it very difficult for the weaver to get at the weaving mechanism to repair broken warp ends or broken weft ends, as was pointed out above, with regard to the device in U.S. Pat. No. 3,627,201. It should also be pointed out, however, that the air flow provided by both of these patents is generalized and is not concentrated upon the surfaces where the lint is most likely to accumulate. The general flow of air through these all encompassing housings does not remove the lint from the machine surfaces unless the flow is so strong as to cause false stops of the warp motion. While the device in U.S. Pat. No. 3,378,998 might be adequate for conditioning the yarn, it is not adequate for cleaning the surfaces of the weaving machine, and is so burdensome upon the weavers as to preclude its commercial usage.

An early attempt to clean a weaving machine was suggested in U.S. Pat. No. 1,850,502. In this patent, a pan-like device is located below the warp threads between the harnesses and the whip roll for collecting dust, fly and lint by a downdraft of air induced by a suction device, which is connected to the bottom of the pan or receptacle. While this device may collect some fly or lint from the warp yarns there is no suggestion that this device could clean adjacent surfaces of the weaving machine or condition the warp yarn by drawing the ambient atmosphere over and through the warp yarns.

A more recent attempt, which is similar to that of U.S. Pat. No. 1,850,502 is found in U.S. Pat. No. 2,984,263. In the system shown in this patent, a collection system is mounted directly on the weaving machine under the stop motion where it is said that the major fly and lint accumulation takes place. The system of this patent primarily utilizes a directed high velocity stream of air to cause a low pressure area in its surrounding environment, which draws the lint and fly to it and then transmits the lint and fly to a desired collection point. The use of such an air stream is said to be much more efficient than the use of a vacuum, and thus enables the device to collect large portions of lint and fly without the use of large, powerful or expensive equipment. While the device shown in this patent may be an efficient collector of lint which falls onto the surfaces of its baffles, there is nothing in this patent to indicate that the ambient atmosphere of the weave room is drawn across the surfaces of the warp yarn to condition such yarn prior to weaving. Furthermore, no provision is made for cleaning the surfaces of the heddles or harnesses or weft insertion device where large amounts of fly and lint are also generated.

In U.S. Pat. No. 3,451,435 a nozzle body with the shape of a prism is positioned across the warp directly above the reed and adjacent to the heddles of the weaving machine so that air currents containing dust are fanned by the oscillating reed into the inlet of a suction nozzle. While this device may be adequate to remove lightweight dust, fly or lint set into motion already by the reed, it is not adequate for conditioning the warp yarn or the weft yarn, nor does this mechanism suggest or teach any way in which the stop motion can be cleaned and the warp yarn conditioned at the same time.

Another more elaborate attempt to provide a cleaning mechanism for a weaving machine is found in U.S. Pat. No. 3,311,135. In this system, the patentees suggest the provision of one enclosure for the sley and reed and another enclosure for the warp stop motion, and still a third enclosure for the harness mechanism. The patentees suggest that the air within the various enclosures is conditioned and that such housings or enclosures, prevent the escape of lint or fly into the weave room at large. While the enclosures shown and suggested in this patent will enable the maintenance of the desired atmospheric conditions within the chambers and will provide some cleaning of adjacent weaving machine surfaces, it still suffers from the adverse drawback of being very difficult for the weaver to operate the weaving machines with this mechanism in place.

Still another attempt to provide a cleaning mechanism is found in U.S. Pat. No. 3,678,965. In this patent, lint and fly is said to be effectively and efficiently removed by suction box 34 located in the path of the warp yarns between the warp stop motion and the harnesses, with a first suction opening directed towards the warp stop motion, and a second suction opening directed towards the harnesses. Suction means is connected to the suction box for drawing the atmosphere across the warp stop motion and across the harnesses. However, this device is in a position which will necessarily interfere with the weaving operations by the weavers. For example, one merely has to observe FIG. 1 to determine how difficult it would be for the weaver to repair broken warp yarns which requires him to thread-up a new yarn through the stop motion, the hood and the warp heddles. Thus, such handicaps to the weaver makes it very unlikely that this device can function successfully on a commercial basis.

SUMMARY OF THE INVENTION

It is a primary object of this invention to provide an improved system for removing lint, size, oil, fly or other contaminating substances from selected surfaces of the weaving machine, while at the same time drawing air from the ambient atmosphere across the weft to condition the weft yarns.

Still another object of the invention is to provide means for drawing air from the ambient atmosphere across the weft loading station and the weft yarn to condition the weft yarn and to provide an air flow across the adjacent weaving machine surfaces.

It is a still further object of the invention to provide means for conditioning the weft yarn and for cleaning the surfaces of the weaving machine at the weft loading and picking station of the weaving machine.

These and other objects and advantages of the invention will appear from a description taken hereinafter in connection with the accompanying drawings, illustrating a preferred embodiment of the form of the invention to accomplish these objectives.

The present invention generally provides at least one vacuum chamber locatable adjacent the weft loading and picking station of a weaving machine for conditioning the weft yarn at same and for cleaning adjacent surfaces of the weaving machine thereat. Preferably, a first vacuum chamber is provided, having a configuration to fit snugly into an opening beneath the weft loading and picking station with at least one and preferably two further vacuum chambers secured to the first chamber and extending outwardly therefrom adjacent an underside of the static. The further vacuum chamber or chambers are provided with a longitudinal slot that extends along the picking station through which oil, lint, fly and the like is removed from the immediate environs where a partial vacuum is created within the chamber, with ambient air being drawn across the weft yarn for conditioning same.

BRIEF DESCRIPTION OF THE DRAWINGS

The invention will be better understood when considering the following detailed description in conjunction with the accompanying drawings wherein:

FIG. 1 is a perspective view of the loading and picking station of a weaving machine showing the rectangular vacuum chamber for conditioning the weft yarn and for cleaning the surfaces of the adjacent picking and loading mechanism;

FIG. 2 is a perspective view of the picking and loading station of a weaving machine showing the tubular vacuum chamber for conditioning the weft yarn and for cleaning the adjacent surfaces of the weaving machine;

DETAILED DESCRIPTION OF THE INVENTION

Figure 3:
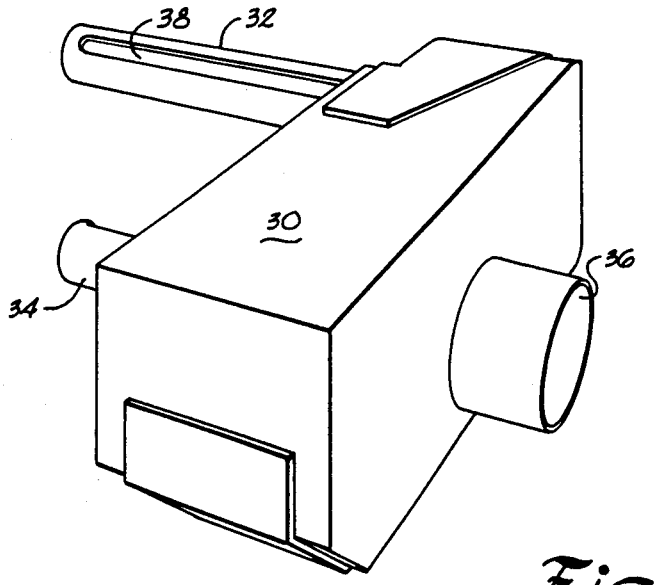
FIG. 3 is a perspective view of a vacuum chamber device for cleaning the picking station and for conditioning the weft yarn.
Figure 4:
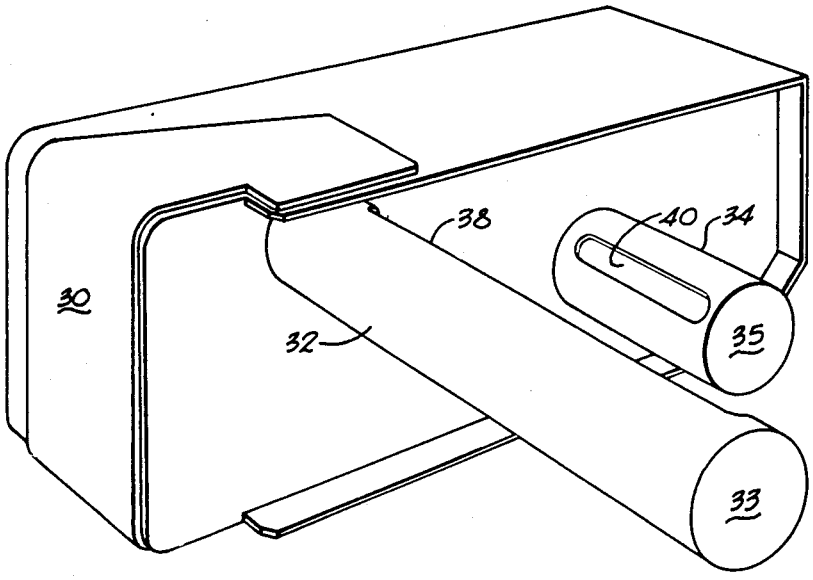
FIG. 4 is a perspective view similar to that of FIG. 3 but showing the other side of the vacuum chamber device.
Figure 5:
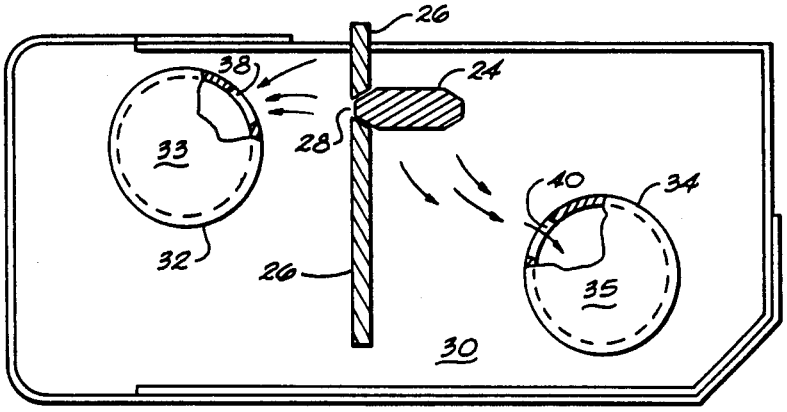
FIG. 5 is an enlarged end view of the vacuum chamber device for cleaning the loading station and for conditioning the weft yarn taken along line 5—5 of FIG. 2 with some parts broken away for clarity.
Figure 6:
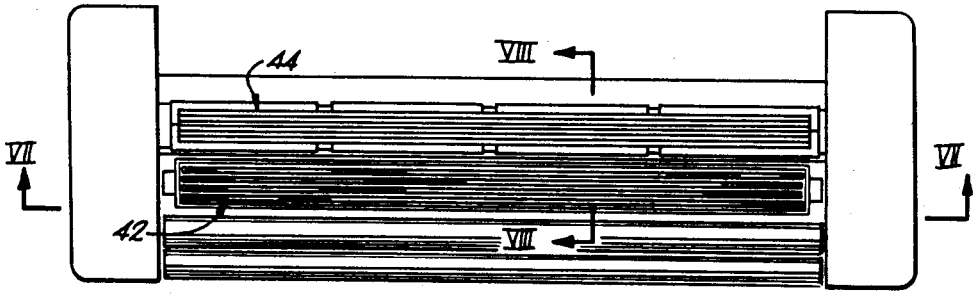
FIG. 6 is a top plan view of the warp stop motion and the harnesses on a weaving machine.

Referring now to FIGS. 1–5 of the drawings, FIGS. 1 and 2 show the loading and picking station of a weaving machine such as those manufactured by Sulzer of Winterthur, Switzerland. Picking station 20 comprises weft yarn guides 23 and 23' for presenting the weft yarn 22 to a gripper shuttle 24. Gripper shuttle 24 fits within a slot 28 formed by upper and lower shuttle guide rails 26.

A closed rectangular vacuum chamber 30 is disposed beneath the picking station and comprises two tubular (i.e. hollow, elongated) vacuum chambers 32 and 34 which extend horizontally from the rectangular vacuum chamber 30. Tubular vacuum chambers 32 and 34 are pneumatically sealed at their ends 33 and 35, respectively. Tubular vacuum chambers 32 and 34 are provided with elongated slots 38 and 40, respectively. Slots 38 and 40 are located so as to draw air from the ambient atmosphere of the weave room whenever a partial vacuum is created within tubular vacuum chambers 32 and 34 or rectangular vacuum chamber 30. Thus, as shown more clearly in FIG. 5, slots 38 and 40 are disposed so as to draw air from the ambient atmosphere across different surfaces of the upper and lower guide rails and the projectile, as well as across the weft yarn itself.

Rectangular vacuum chamber 30 also acts as a baffle in that it fits snugly within the available space on the weaving machine beneath the loading station and prevents air from the ambient atmosphere from being drawn along the longitudinal axes of tubular vacuum chambers 32 and 34. This assures that air drawn into said tubular chambers will pass over the weft yarn and the surfaces of said loading station.

The ambient atmosphere in the weave room is one in which the relative humidity is raised to a level which is conducive to proper weaving conditions. Inasmuch as the vacuum chambers of the invention have a partial vacuum created within the vacuum chambers, this causes air from the ambient atmosphere to rush across the weft yarn and the adjacent surfaces of the weaving machine, thereby removing accumulated lint, fly, oil or dust as well as drawing the humidified air across the weft yarn to thereby condition the yarn by increasing the water content thereof at precisely the point at which such yarn is under its greatest strain or stress, i.e. during the weft insertion stage of the weaving process.

The vacuum within the tubular vacuum chamber and rectangular vacuum chamber 30 is created by a suitable pump or vacuum source within the weave room through exhaust pipe 36. Exhaust pipe 36 also directs any lint, fly, size, oil or the like which may be cleaned from the adjacent weaving machine surfaces to a waste recovery station (not shown). This waste recovery station may be provided for each individual weaving machine in the case of an individual drive or individual suction device, or to a central collection station where a central system is used within the weave room.

Figure 7:
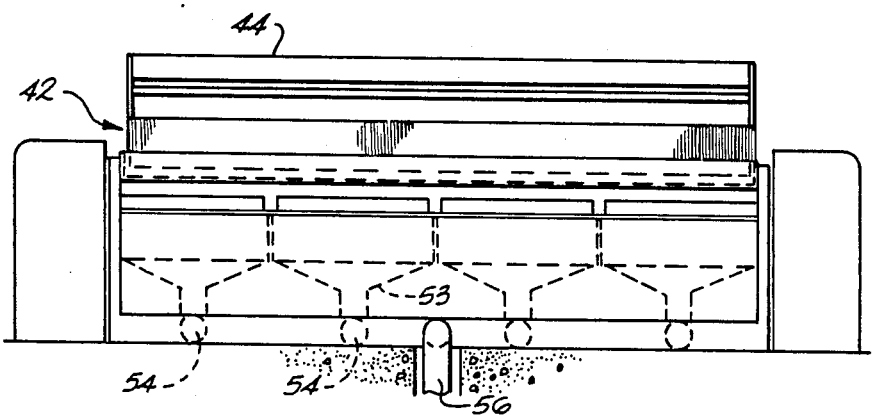
FIG. 7 is a rear view of a weaving machine taken along line 7—7 of FIG. 8 with some parts shown in phantom for clarity.
Figure 8:
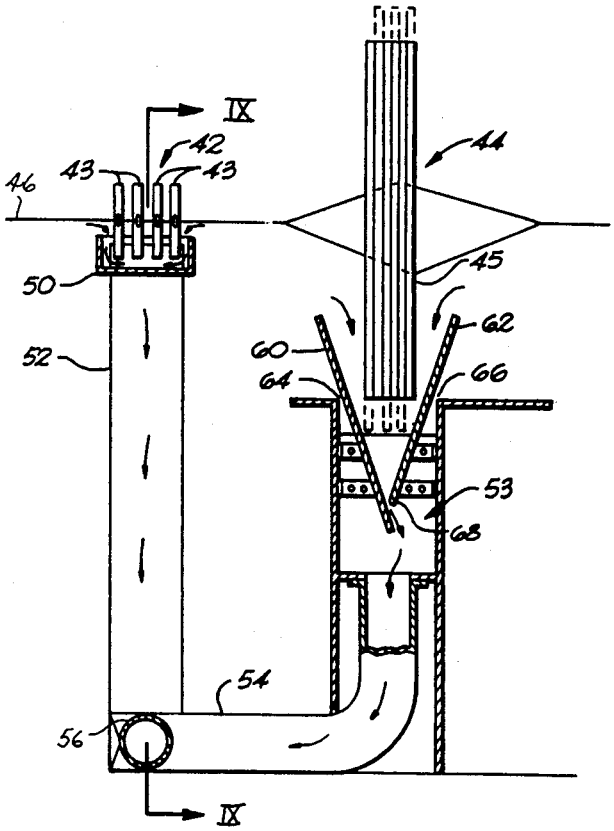
FIG. 8 is a side sectional view of the weaving machine taken along line 8—8 of FIG. 6 and enlarged for clarity.

Referring now to FIGS. 6, 7, 8 and 9, wherein the vacuum chambers for cleaning the warp stop motion and the harnesses and for conditioning the warp yarn are shown in detail. As best seen in FIG. 8, the warp yarns 46 are drawn from a beam (not shown) through a series of drop wires 43 at warp stop motion 42. As is common in such warp stop motions, each warp end is provided with its own drop wire in either a mechanical or electrical warp stop motion. Surrounding the lower portion of the drop wires is a vacuum chamber 50, having four walls, disposed to draw air from the ambient atmosphere of the weave room across the drop wires 43 and the warp yarns 46 for removing all lint, fly, dust, size, oil or the like from the surfaces of the drop wires and for conditioning the warp yarn by concentrating the air from the ambient atmosphere onto such yarn just prior to its being subjected to its greatest stress during the weaving process, i.e. the formation of the warp sheds and the beat-up process. The concentration of the air drawn from the ambient atmosphere on the warp yarn increases the moisture content of the warp yarn over that naturally absorbed by its passage through the unconcentrated ambient atmosphere. This permits a lower relative humidity to be utilized in the ambient atmosphere for a given moisture content in the warp yarn. Vacuum chamber 50 extends the length of the warp stop motion and has walls which partially surround the drop wires. At one end of the vacuum chamber 50 is an exhaust pipe or duct 52. Exhaust duct 52 extends down the side of the weaving machine and extends to a central duct 56 which is connected to a central collection point either on the weaving machine itself or to a central collection system for the entire weave room.

Figure 9:
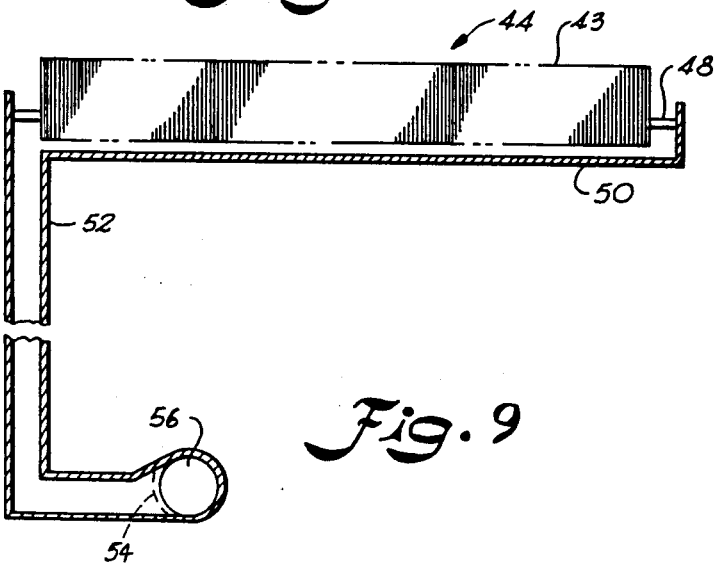
FIG. 9 is a rear cross-sectional view of the vacuum chamber at the warp stop motion taken along line 9—9 of FIG. 8.

Disposed beneath the harnesses 44 is a generally rectangular vacuum chamber 53. Vacuum chamber 53 is connected to central exhaust duct 56 through exhaust duct 54, as best seen in FIGS. 7 and 9. Where the weaving machines are very wide, vacuum chambers 53 and 50 may be compartmentalized as shown in FIG. 7. That is, different sections of the vacuum chambers may be separately exhausted so as to provide more uniform movement of air from the ambient atmosphere across the warp yarns and the adjacent surfaces of the weaving machine for cleaning the same.

Disposed within vacuum chamber 53 are two baffles 60 and 62. The surfaces of baffles 60 and 62 lie in planes that extend at an angle to each other and intersect beneath the harnesses. Baffle 60 extends beyond the intersection point, whereas baffle 62 terminates short of baffle 60 so as to provide an exhaust slot or port for exhausting the dust, lint, fly, oil or other foreign material which may be removed from the surfaces of the heddles and harnesses by passage of air from the ambient atmosphere across the surfaces when a partial vacuum is created within the vacuum chamber.

Clearances 64 and 66 are also provided between the upper portions of baffles 60 and 62 and the adjacent surfaces of the walls of the vacuum chamber. The use of baffles 60 and 62 permit a greater velocity movement of air currents across the surfaces of the weaving machine and through the warp yarn for a given energy consumption in the vacuum creating mechanism.

As will be seen in FIG. 8, the positions of baffles 60 and 62 may be adjustable so as to vary the size of slot 68 and clearances 64 and 66. By varying the size of slot 68 and clearances 64 and 66, the velocity of the air drawn from the ambient atmosphere may be varied for a given vacuum within the vacuum chamber.

As illustrated herein, the hollow, elongated vacuum chambers adjacent to the picking station may have a round cross-section, a rectangular cross-section, or other cross-section, as desired, and as space permits. For example, chambers 30, 32, 34, 50, and 53 may be so varied, as desired. It will also be understood that the means for creating a partial vacuum within the vacuum chambers may be provided for each individual weaving machine with its own individual vacuum pump and motor, or the vacuum creating mechanism may be provided at a central station within the weaving room with suitable connections to each of the weaving machines. The use of a central collection point makes recovery of the waste material more efficient.

In any event, whether the pneumatic source is provided for individually on the weaving machines or by a central location, means are contemplated for turning the vacuum producing means off for individual weaving machines. Means are provided for closing a suitable damper in the exhaust system when the weaving machine ceases operation; for example, in exhaust duct 56, when a central collection system is utilized.

While there is shown and described a preferred embodiment of the invention using specific terms, it is to be understood that the invention is not limited thereto but may be otherwise variously embodied and practiced within the scope of the appended claims.

What is claimed is:

1. A cleaning and weft conditioning system for a weaving machine which has a warp supply, harnesses having a plurality of heddles, a reed supported on a sley, means for selectively raising and lowering the heddles and the warp yarns passing from said warp supply through said heddles and through said reed to form warp sheds, a weft insertion system, and a loading station whereat weft yarns are loaded into said weft insertion system and are picked through said warp sheds for forming a fabric, said cleaning and weft conditioning system comprising:

(a) a first vacuum chamber disposed adjacent to the weft loading station;

(b) at least one hollow, elongated vacuum chamber extending from one side of said first vacuum chamber and in pneumatic communication therewith, with a free end of said elongated chamber being closed, said elongated chamber further having a narrow slot extending longitudinally along said hollow, elongated vacuum chamber, and along at least a part of the path on which weft yarns are loaded into the weft insertion system, so as to draw air from the ambient atmosphere across the weft yarn and across adjacent surfaces of the loading station and the weaving machine, whenever a partial vacuum is created in said vacuum chambers; and (c) means for creating a partial vacuum within said vacuum chambers thereby causing a portion of the ambient atmosphere of the weave room to be drawn across the weft yarn at the loading station to condition it and across adjacent surfaces of said weaving machine to remove lint, fly, size or the like from said surfaces.

2. A cleaning and weft conditioning system as set forth in claim 1, wherein said hollow, elongated vacuum chamber has a round cross-section.

3. A cleaning and weft conditioning system as set forth in claim 1, further including a second hollow, elongated vacuum chamber extended from said one side of said first vacuum chamber and in pneumatic communication therewith at one end of such second chamber, the other end of such second elongated chamber being closed, said second elongated chamber further having a narrow slot extending longitudinally similar to the first-mentioned hollow, elongated vacuum chamber and also positioned so as to draw air from the ambient atmosphere across the weft yarn and across adjacent surfaces of said loading station and said weaving machine when a partial vacuum is created within said first vacuum chamber.

4. A cleaning and weft condition system as set forth in claim 1, wherein said hollow, elongated chamber has a rectangular cross-section.

5. A cleaning and weft conditioning system for a weaving machine which has a warp supply, harnesses having a plurality of heddles, a reed supported on a sley, means for selectively raising and lowering the heddles and warp yarns passing from said warp supply through said heddles and through said reed to form sheds, a weft insertion system, and a loading station whereat weft yarns are loaded into said weft insertion system and are picked through said warp sheds for forming fabrics, said cleaning and weft conditioning system comprising:

(a) at least one hollow, elongated vacuum chamber disposed adjacent to said loading station, said one vacuum chamber having a free closed end and further having a narrow slot extending longitudinally along and through a wall of said one vacuum chamber and along at least part of the path of the weft yarn to draw air from the ambient atmosphere across the weft yarn and the adjacent surfaces of the loading station and the weaving machine when a partial vacuum is created within said at least one vacuum chamber; and (b) means for creating a partial vacuum within said at least one vacuum chamber thereby causing a portion of the ambient atmosphere of the weave room to be drawn across the path of the weft yarn to condition it and across adjacent surfaces of said loading station and said weaving machine to remove lint, fly, size and the like therefrom.

6. A cleaning and weft conditioning system as set forth in claim 5, further comprising baffle means, adapted to fit within available space on said weaving machine, for preventing air from being drawn longitudinally of said at least one vacuum chamber and for ensuring that air drawn from the ambient atmosphere is drawn across the weft yarn and across the adjacent surfaces of said loading station and said weaving machine.

7. A cleaning and weft conditioning system as set forth in claim 6, wherein said baffle means includes a generally rectangular vacuum chamber operatively interposed between said at least one vacuum chamber and said means for creating a partial vacuum.

8. A cleaning and weft conditioning system as set forth in claim 6, wherein said at least one vacuum chamber has a round cross-section.

9. A cleaning and weft conditioning system as set forth in claim 6, wherein said at least one vacuum chamber has a rectangular cross-section.

10. A cleaning and weft conditioning system as set forth in claim 5, further including a second vacuum chamber similarly constructed as said at least one vacuum chamber and extending parallel thereto, with each of said respective slots thereof being directed towards different surfaces of the weaving machine.

11. In a weaving machine having a warp supply, harnesses having a plurality of heddles, a reed supported on a sley, means for selectively raising and lowering the heddles and warp yarns passing from said warp supply through said heddles and through said reed to form warp sheds, a weft insertion system, a loading station whereat weft yarns are loaded into said weft insertion system and are picked through said warp sheds for forming a fabric, means for conditioning the weft yarns and for cleaning lint, size, oil and fly from selected surfaces of said weaving machine, comprising:

(a) at least one hollow, elongated vacuum chamber disposed adjacent to said loading station, said vacuum chamber having a narrow slot extending longitudinally therealong and opening in a position to draw air from the ambient atmosphere across the path of the weft yarns and across adjacent surfaces of the weaving machine whenever a partial vacuum is created in said vacuum chamber; and (b) means for creating a partial vacuum within said vacuum chamber thereby causing a portion of the ambient atmosphere of the weave room to be drawn across weft yarn present on said path thereof to condition it and across adjacent surfaces of said loading station and said weaving machine to remove lint, fly, size or the like from said surfaces.

12. In a weaving machine as set forth in claim 11, wherein one end of said at least one vacuum chamber is pneumatically sealed and the other end is supported by and opens into a generally rectangular vacuum chamber which has a larger capacity than does said at least one vacuum chamber and which serves as a baffle to prevent air from being drawn from the ambient atmosphere on a side of said rectangular vacuum chamber opposite that which supports said at least one vacuum chamber.

13. In a weaving machine as set forth in claim 11, wherein said at least one vacuum chamber has a round cross-section.

14. In a weaving machine as set forth in claim 11, wherein said at least one vacuum chamber has a rectangular cross-section.

15. In a weaving machine as set forth in claim 11, further including a second hollow, elongated vacuum chamber disposed adjacent to said loading station, said second chamber also having a narrow slot extending longitudinally therealong and opening in a position to draw air from the ambient atmosphere across the path of the weft yarn and across adjacent surfaces of the loading station and the weaving machine whenever a partial vacuum is created within said tubular vacuum chamber.

16. In a weaving machine as set forth in claim 15, wherein each of said hollow, elongated vacuum chambers has one end thereof pneumatically sealed and the other end thereof connected to a generally rectangular vacuum chamber which has a greater capacity than that of the two hollow, elongated vacuum chambers combined.

17. In a weaving machine as set forth in claim 15, wherein each of said hollow, elongated vacuum chambers has a round cross-section.

18. In a weaving machine as set forth in claim 15, wherein each of said hollow, elongated vacuum chambers has a rectangular cross-section.

19. In a weaving machine having a warp supply, harnesses having a plurality of heddles, a reed supported on a sley, means for selectively raising and lowering the heddles and warp yarns passing from said warp supply through said heddles, and through said reed to form warp sheds, a weft insertion system, and a loading station whereat weft yarns are loaded into said weft insertion system and are picked through said warp sheds for forming a fabric, means for conditioning the weft yarn and for cleaning lint, size, oil and fly from selected surfaces of said loading station and said weaving machine comprising:

(a) a first vacuum chamber disposed on said weaving machine so as to block longitudinal movement of air from the ambient atmosphere between respective sides thereof;

(b) a pair of tubular vacuum chambers disposed adjacent to said loading station, being respectively supported by and in pneumatic communication with said first vacuum chamber, and having respective narrow slots extending longitudinally therealong and opening in a position to draw air from the ambient atmosphere across the path of the weft yarn and across adjacent surfaces of the loading station and the weaving machine whenever a partial vacuum is created in said tubular vacuum chamber; and (c) means for creating a partial vacuum within said vacuum chambers thereby causing a portion of the ambient atmosphere of the weave room to be drawn across weft yarn present in said path thereof to condition it and across adjacent surfaces of said loading station and said weaving machine to remove lint, fly, size or the like from said surfaces.

20. In a weaving machine as set forth in claim 19, wherein said weft insertion system comprises a gripper shuttle, a plurality of guide elements disposed to guide said gripper shuttle through said warp sheds and a stationary picking station whereat weft yarns are loaded into said gripper shuttle and said gripper shuttle is picked through said guide elements and said warp shed for forming a fabric.

* * * * *